United States Patent [19]

Webb

[11] 4,161,955

[45] Jul. 24, 1979

[54] COMBINATION MIRROR/HAIR DRYER

[76] Inventor: Robert Webb, 145 N. 410 W., St. George, Utah 84770

[21] Appl. No.: 805,531

[22] Filed: Jun. 10, 1977

[51] Int. Cl.[2] ..... A45D 20/00

[52] U.S. Cl. ..... 132/9; 34/90

[58] Field of Search ..... 132/9, 102; 350/305, 350/306; 248/480, 484; 98/1; 160/335; 279/41; 296/84 B; 403/142

[56] References Cited

U.S. PATENT DOCUMENTS

| | | | |
|---|---|---|---|
| 3,019,709 | 2/1962 | Teason | 350/305 |
| 3,584,390 | 6/1971 | Barker | 132/9 |
| 3,730,612 | 5/1973 | Arroyo | 350/305 |

*Primary Examiner*—G. E. McNeill

*Attorney, Agent, or Firm*—Seiler & Quirk

[57] ABSTRACT

A custom grooming device has relatively opposing mirrors mounted on a base. A portable pistol-type hair dryer is mountable on the base; air from the dryer flows through a hose to an exhaust port located near one of the mirrors. The mirrors are adjustable in height and angle for viewing all parts of the head.

10 Claims, 5 Drawing Figures

COMBINATION MIRROR/HAIR DRYER

BACKGROUND OF THE INVENTION

This invention relates to an adjustable mirror system having a plurality of mirrors to enable the user to view the back of his head, the system also having the ability to mount a blow drier and to direct the air stream to the desired location.

In recent years, hair styles for both men and women have become increasingly casual. Women have adopted styles which require a minimum amount of time for care, frequently cutting their hair shorter. On the other hand, men's hair has tended to be worn longer than in the recent past; however, men are not accustomed to spending a great amount of time to fix their hair, and have tended to adopt relatively simple styles. The hand-held, pistol type blow dryer has become extremely popular with both men and women, since it is easily portable and storable, while still being effective in providing rapid drying capability.

With practice, the user of a blow dryer can become quite skillful at styling his hair. By using the proper implements, including brushes and combs of various shapes, curling irons, clips, rollers and the like, and with proper direction and control of the air flow, a variety of styles can be quickly generated. The hand-held dryers are particularly convenient since the air flow can be directed to the precise location desired, and the direction, temperature and force of the air flow can be quickly adjusted by moving the dryer around the user's head.

The main limitation of the pistol-type blow dryer is the necessity of holding the dryer in one hand, leaving only one hand free for brushing or combing. Some users have considerable difficulty in controlling the hair style with only one hand, particularly when a strong stream of air is blowing on the hair. Particular problems are associated with styling the back of the head, since the user cannot see what is happening. Accordingly, it is an object of the invention to combine a blow dryer with a mirror to allow the user freedom to use both hands to style his hair.

It is a further object of the invention to provide an apparatus for mounting a portable pistol-type blow dryer with a mirror, and to provide a conduit for delivering air flow from the dryer to an outlet proximate to the mirror.

It is a further object to provide a system of two mirrors which can enable a user to view the back of his head while using a blow dryer.

It is a further object of the invention to provide apparatus for mounting a portable hair dryer, the apparatus having a pair of adjustable mirrors and a conduit for carrying the air flow to an exit near one of the mirrors.

It is well-known to have a pair of opposing adjustable mirrors spaced apart to enable a user to view sequentially all portions of his hair. For example, Eble et al, U.S. Pat. No. 763,380 shows a mirror having an adjustable bracket which can be mounted on a dresser. The user can swing the mirror into position for use in conjunction with the existing dresser mirror.

Another system is shown in Arroyo et al, U.S. Pat. No. 3,730,612, issued May 1, 1973. This patent discloses a wall-mountable bracket having a vertical bar on which a telescoping arm is adjustably mounted. A removable mirror can be hung on the end of the arm for use with an existing mirror for viewing the back of the head. However, these systems provide only one mirror on the device itself, and make no provision for mounting a hair dryer.

SUMMARY OF THE INVENTION

Apparatus for hair drying and viewing comprises a base, a vertically adjustable mirror mounted on the base, mounting means carried by the base for removably mounting a portable hair dryer, flow directing means for directing the flow of air to a desired location, and optionally, a second adjustable mirror carried by an arm attached to the base.

BRIEF DESCRIPTION OF THE DRAWINGS

Referring to the drawings.

DETAILED DESCRIPTION OF THE INVENTION

Figure 1:
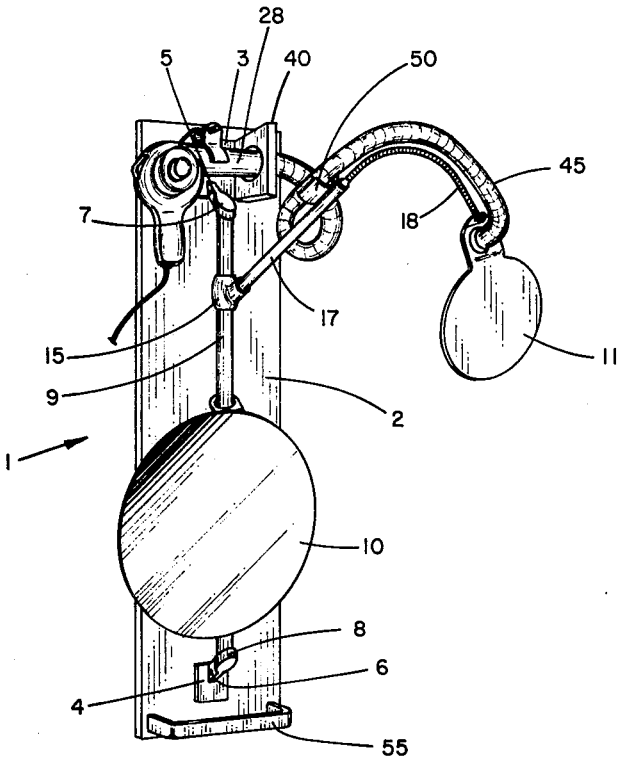
FIG. 1 is a perspective view of a device of a combination of the invention showing the pistol-type dryer mounted on the device.
Figure 2:
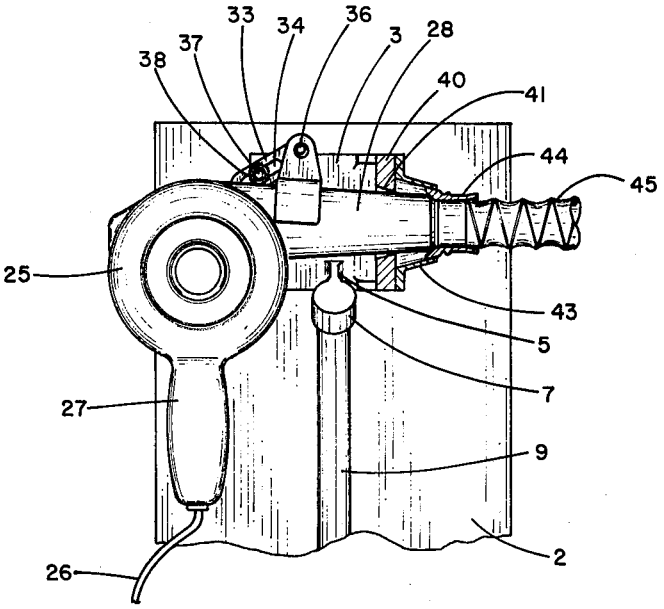
FIG. 2 is a partially sectioned front view of the dryer mounting portion of the device with the dryer in place.

Referring to FIG. 1, grooming device 1 has a rectangular wall-mountable base 2. Upper and lower mounting plate 3 and 4 have outwardly projecting ears 5 and 6 with cups 7 and 8 to receive the ends of vertical rod 9. The vertical rod is used to mount front mirror 10 and rear mirror 11.

Figure 3:
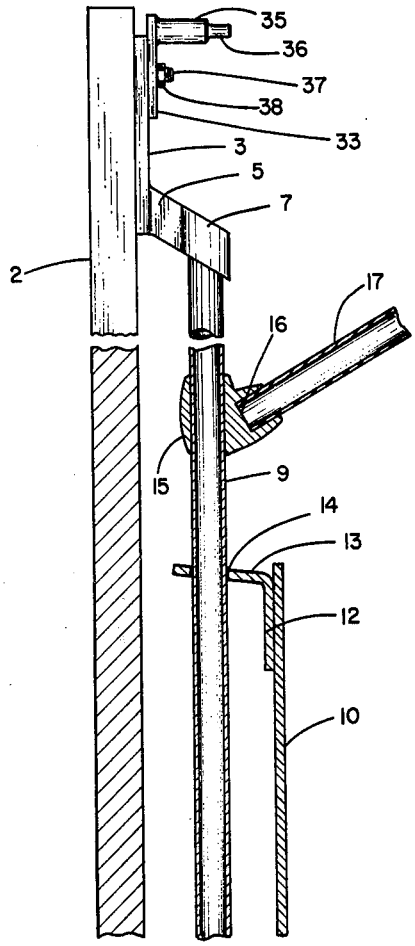
FIG. 3 is a partial side view of the apparatus showing the mounting of the front mirror and rear mirror arm on the vertical mounting rod.

Front mirror 11 is a relatively large round mirror, which may be either glass or plastic, and is vertically adjustable to suit the height of the user. The mirror is slidably mounted on the rod by means of a bracket 12 affixed to the upper rear portion of the mirror. The bracket has a substantially horizontal ear 13 having a hole 14 therein (see FIG. 3) of slightly greater diameter than the outside diameter of the rod. The ear grips the vertical rod by means of friction that depends on the moment generated by the weight of mirror 10. The rod and mirror bracket are preferably made of plastic, such as polyvinyl chloride, polyethylene, or ABS, in which case special design for the friction fitting is not necessary. If the parts are made from a polished metal, it may be desirable to mill diametrically opposed offset clearances in the hole in the ear as shown in U.S. Pat. No. 3,730,612. Alternatively, a mounting sleeve concentric with the rod could be used instead of the ear, with an axial thumbscrew in the sleeve used to lock the mirror in place on the rod. For most cases, the sleeve will be held in place by friction in the same manner as ear 13 on bracket 12, and can easily be moved up and down the rod simply by lifting upwardly on the front of the sleeve.

The rear mirror is also slidably mounted on the rod at a location above the large mirror 10 by means of a mounting sleeve 15 having a upwardly angled, forwardly projecting female joint 16 which receives the lower end of arm 17. Arm 17 optionally connects to section of bendable cable 18, which is sufficiently flexible to be fashioned into any shape by hand, but which is sufficiently rigid to retain its desired shape. This cable, of the type commonly used in "goose-neck" lamps, allows the user to place the rear mirror in any desired location at any angle. This cable length is optional, and can be replaced for most uses by using a ball-and-socket type fitting at the end of arm 17. If desired, arm 17 can have a telescoping feature to extend to different lengths for children and large adults.

Figure 4:
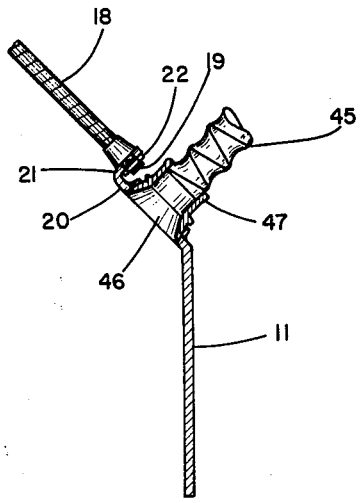
FIG. 4 is a partially sectioned side view of the rear mirror showing the blower exhaust port.
Figure 5:
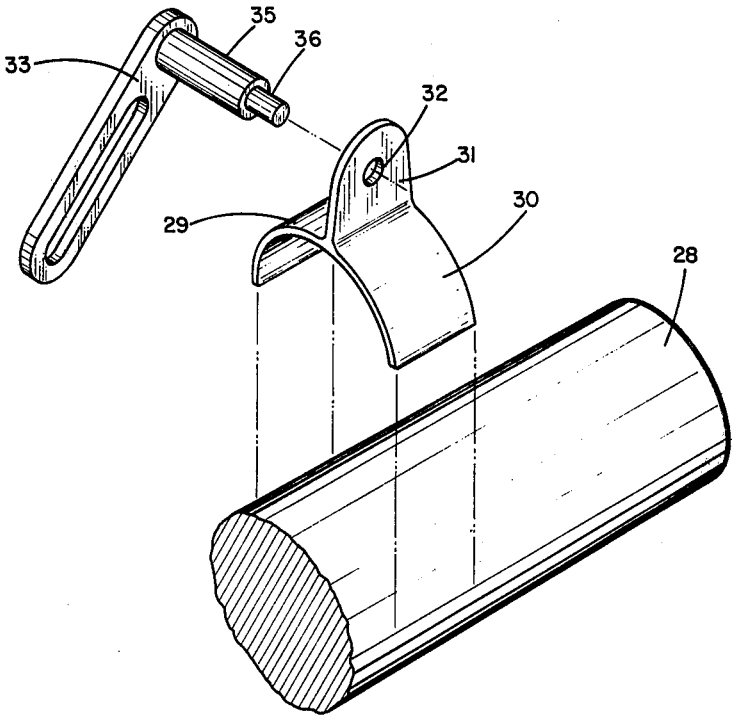
FIG. 5 shows the method of mounting the dryer on the device, with the carrier for the dryer shown in exploded view.

Rear mirror 11 is mounted at the end of cable 18, which terminates in threaded male end 19 (see FIG. 4). The mirror has an angled upper lip 20 with mounting bracket 21 having a hole therein for receiving threaded end 19 of the cable. The mirror is fastened to the cable by nut 22. The angle of the mirror can be adjusted by loosening the nut, rotating the mirror, and retightening the nut, in addition to bending the cable 18. As indicated above, this fitting could be replaced by a ball-and-socket joint, for example of the type shown in U.S. Pat. No. 763,380.

A very important feature of the invention is the mounting means for a conventional hair dryer. Pistol-type dryer 25 having electrical cord 26, grip 27, and exhaust barrel 28 is supported at the upper portion of base 2. Hanger 29 is attached to the upper portion of the gun barrel with adhesive or glue, and consists of a base portion 30 which is curved to fit the dryer barrel, and a vertical ledge 31 having a centrally located base 32 for hanging the dryer. The base 30 may be rigid and manufactured with a curvative to fit most barrels, or may be slightly flexible so that it may be easily pressed into place around the barrel.

The hanger is supported by peg 36 at the end of dowel 35 which extends horizontally from the end of adjustable mounting bracket 33. Mounting bracket 33 has a slot 34 along the length thereof, and is fixed to mounting plate 3 by bolt 37 extending through the plate and the slot and fastened by locking nut 38.

Dryer barrel support 40 extends outwardly from the mounting plate 3 and has an orifice 41 therein for receiving the barrel. Support 40 is fabricated from relatively soft rubber or plastic material to act as a gasket to prevent leakage of air back through the orifice. The orifice is preferably tapered to easily admit barrels of different sizes and to ensure a good seal.

Hose mount 43 is fastened to the front of barrel support 40 and receives the end 44 of flexible plastic hose 45. Hose 45 extends to opening 46 (see FIG. 4) in upper lip 20 of the rear mirror, where it is attached by a conventional exhaust fitting 47. The hose is supported by saddle 50 attached to arm 17; the hose rests on the saddle to keep it from interfering with the user, but can slide back and forth over the saddle as the arm 17 is swiveled about the mounting rod 9.

Tray 55 is located at the bottom of the base to hold miscellaneous equipment such as pins, clips, rollers, curling irons, and the like.

While a specific mounting mechanism for the dryer has been described, any mechanism which will removably support the dryer on the apparatus such that the gun barrel communicates properly with the hose is sufficient. For example, a horizontal sleeve could be located on mounting plate 3 which would receive and support the gun barrel; alternatively, adjustable support brackets could be located at the upper edge of grip 27 on which the dryer could rest. These support systems would not require a permanent fixture to be added to the dryer, as the hanger 29 is shown to be fixed to the barrel.

Use of the apparatus of the invention is quite simple. First, the base is attached to a wall by any convenient fastening means such as screws, nails, or hooks. Next, the gun hanger 29 is attached to the top of a conventional dryer, and the dryer is supported in place by placing the barrel through orifice 41 and moving the hole 32 in the hanger over peg 36. This may require adjustment of the mounting bracket 33 for the first use. Front mirror 10 is adjusted to the height of the user by sliding it along the mounting rod, and rear mirror 11 is similarly adjusted. The dryer is turned on, and air is forced through the flexible hose and out exhaust port 46.

The user can then face the rear mirror and style the front of his hair using the air blowing through the exhaust port to dry the front of his hair. He then faces the front mirrors, adjusts the rear mirror such that the air is properly directed and the rear of his head is visible by means of the rear and front mirrors, and styles the rear and sides of his head. In each case, both hands are free for use in styling. When the user is finished, the arm 17 may be rotated back toward the base for easy out-of-the-way storage.

Many modifications are possible within the spirit and scope of the invention. For example, the exhaust port could be located near the front mirror rather than the rear mirror, it is useful for convenience to have the exhaust port located in the proximity of one of the mirrors. Indeed, if the dryer mounting mechanism itself is adjustable such that the dryer can be directed near one of the mirrors, the flexible hose may be eliminated. If desired, the dryer could be mounted directly on the arm holding the second mirror. Accordingly, the specific embodiment disclosed herein should be considered illustrative rather than restrictive, and the invention should be limited only by the following claims:

I claim:

1. Hair drying-mirror apparatus for use in combination with a pistol-grip portable hair dryer comprising a base, a mirror mounted on the base, adjustment means for varying the vertical position of the mirror on the base, mounting means for removably holding a pistol-grip portable hair dryer on the base, and adjustable direction means for adjustably directing the flow of air from the dryer to a desired location.

2. The apparatus of claim 1 also comprising conduit means for directing air flow from the dryer to a location near the mirror.

3. The apparatus of claim 2 wherein one end of the conduit means comprises connecting means for joining the exhaust port of the hair dryer to the conduit, and also comprises sealing means associated with the connecting means for substantially preventing air leakage from the connecting means.

4. The apparatus of claim 3 wherein the conduit means comprises a flexible hose.

5. The apparatus of claim 1 also comprising a second mirror, a mirror mounting arm, arm mounting means adjacent a first end of the mounting arm for attaching the arm to the base, and mirror mounting means adjacent a second end of the mounting arm for attaching the second mirror, the adjustable direction means comprising conduit means for directing air flow from the dryer to a location near one of the mirrors.

6. The apparatus of claim 5 also comprising conduit means for directing air flow from the dryer to a location near the second mirror.

7. The apparatus of claim 6 wherein the conduit means comprises a flexible hose having an inlet end disposed adjacent to the mounting means for the hair dryer and an exhaust port carried by the mirror mounting arm adjacent to the second mirror.

8. The apparatus of claim 5 wherein the base comprises a rigid vertical rod, the mirror comprises mounting means for slidably mounting the mirror on the rod, and the arm mounting means comprises a sleeve member slidably and swivelably mounted on the rod.

9. Combination hair drying/mirror apparatus having a base, a first mirror mounted on the base, a mounting arm movably fixed to the base, a second mirror adjustably attached to the mounting arm at a location remote from the first mirror such that a user can place his head between the two mirrors and view the back of his head, the improvement therein comprising support means carried by the base for mounting a pistol-grip portable hair dryer having exhaust means, and air flow directing means for directing air flow from the dryer to a desired location near one of the mirrors.

10. The apparatus of claim 9 wherein the air flow directing means comprises a conduit having an inlet and an exhaust, and the improvement also comprises connecting means for coupling the exhaust means of the dryer with the inlet of the conduit, and mounting means near one of the mirrors for carrying the exhaust of the conduit.

* * * * *